United States Patent [19]

Pungas et al.

[11] 4,281,281

[45] Jul. 28, 1981

[54] REFERENCE VOLTAGE SOURCE

[76] Inventors: Toom A. Pungas, bulvar Sypruse, 219, kv. 3; Toomas E. Parve, bulvar Ryannaku, 3, kv. 7; Mart V. Min, ulitsa Ladva, 26, all of Tallin, U.S.S.R.

[21] Appl. No.: 951,508

[22] Filed: Oct. 16, 1978

[30] Foreign Application Priority Data

Apr. 27, 1978 [SU] U.S.S.R. ..... 2590404

[51] Int. Cl.[3] ..... G05F 1/40

[52] U.S. Cl. ..... 323/271; 323/282; 328/21

[58] Field of Search ..... 307/261; 323/23, 25, 323/40, 75 F; 328/13, 14, 21, 22, 27; 363/76, 95, 97, 131

[56] References Cited

U.S. PATENT DOCUMENTS

| | | | |
|---|---|---|---|
| 3,215,860 | 11/1965 | Neumann | 328/27 X |
| 3,458,723 | 7/1969 | Hanson | 307/240 |
| 3,484,705 | 12/1969 | Hanson | 328/149 |
| 3,713,137 | 1/1973 | Stone | 328/27 X |
| 3,876,888 | 4/1975 | Gyugyi et al. | 328/14 X |
| 4,131,938 | 12/1978 | Milberger et al. | 323/25 X |
| 4,158,224 | 6/1979 | Kreyer et al. | 363/131 X |

*Primary Examiner*—A. D. Pellinen
*Attorney, Agent, or Firm*—Steinberg & Raskin

[57] ABSTRACT

A reference voltage source comprises a bridge circuit having two avalanche diodes in a first pair of opposite arms and two resistors in a second pair of opposite arms, as well as two operational amplifiers, An AC-DC voltage converter has its input connected to an output terminal of the source. A voltage comparator have inputs connected to the output of the AC-DC voltage converter and the output of a DC voltage setting circuit. The output of the comparator is connected to the non-inverting input of one of the operational amplifiers.

16 Claims, 11 Drawing Figures

$t_1$ $t_2$ $t_3$ $t_4$ $t_5$ $t_6$ $t_7$
$t_8$ $t_9$ $t_{10}$ $t_{11}$ $t_{12}$
$t_{13}$ $t_{14}$ $t_{15}$
$t_{16}$ $t_{17}$ $t_{20}$
t t t t t

REFERENCE VOLTAGE SOURCE

FIELD OF THE INVENTION

The present invention relates to voltage sources and, more specifically, to reference voltage sources. The source of this invention is applicable to automatic measuring systems where it can be used as a time-stabilized calibration signal source.

BACKGROUND OF THE INVENTION

There is known a reference voltage source comprising two closed control loops, each including a compensation DC voltage stabilizer of opposite polarities, which are alternately connected to the output of the source (cf. U.S. Pat. No. 3,458,723).

The source of the aforementioned patent features a low output resistance. On the other hand, it requires the use of time-stable resistors in the divider circuits to ensure a high time stability of the source's output voltage, keeping in mind that the error of the resistor dividers is proportional to the error of the source as a whole. The design of this square-wave voltage is such that it is hard to control the constant component of the output voltage or use electric signals to control the output voltage amplitude within a broad range.

Another known AC voltage source includes an amplitude-controlled sinusoidal voltage generator, a reference square-wave AC voltage source, a thermoconverter to which are alternately applied the output voltage of the generator and the voltage of the reference voltage source, and a detector intended to detect the difference signal at the output of the thermoconverter, which controls the amplitude of the sinusoidal voltage generator (cf. U.S. Pat. No. 3,484,705 or F. L. Hanson, "High-Accuracy AC Voltage Calibration", Hewlett Packard Journal, vol. 19, No. 10, June 1968).

The aforementioned design accounts for a high accuracy and good stability of the output sinusoidal voltage, due to the stable voltage supplied by the reference voltage source. On the other hand, it is impossible to provide a square-wave voltage at the output of the source, although that may be necessary for certain applications. Another disadvantage of this source that it limits the short-time stability of the generator's output voltage because the noise at the input of the detector is considerably amplified due to the use of the deep negative feedback in the system.

Another known reference voltage source comprises a bridge circuit which contains avalanche diodes in a first pair of opposite arms and resistors in a second pair of opposite arms, as well as two operational amplifiers alternately connected to the source's output terminal.

The inverting input of the first operational amplifier is connected to the anode and its output is connected to the cathode of one of the avalanche diodes. The inverting input of the second operational amplifier is connected to the cathode and its output is connected to the anode of the second avalanche diode of the bridge circuit (cf. USSR Inventor's Certificate No. 445,037, Cl. G05 F, 1/56).

The latter reference voltage source is disadvantageous in that it does not permit simultaneous control of the constant component of the output voltage and the amplitude of the square-wave AC voltage.

SUMMARY OF THE INVENTION

It is an object of the present invention to provide a reference voltage source which permits simultaneous control of the constant component and amplitude of the square-wave AC output voltage.

The invention essentially consists of a reference voltage source built around a bridge circuit containing two avalanche diodes and two resistors in its opposite arms. The reference voltage source further includes two operational amplifiers, the inverting input of the first of which is connected to the anode and the output of which is connected to the cathode of one of the avalanche diodes. The inverting input of the second operational amplifier is connected to the cathode and its output is connected to the anode of the second avalanche diode of the bridge circuit. In accordance with the invention, the reference voltage source includes an AC-DC voltage converter having an input connected to the output terminal of the source, a DC voltage setting circuit, and a voltage comparator having a first input connected to the DC voltage setting circuit and a second input connected to an output of the voltage converter. The output of the comparator is connected to the non-inverting input of one of the operational amplifiers.

According to the invention, the reference voltage source may include an integrating circuit having its first input alternately connected to the outputs of the operational amplifiers. A control voltage is applied to its second input of the integrating circuit and the output of said integrating circuit is connected to the non-inverting input of the other operational amplifier.

The source includes an amplifier alternately connected to the outputs of the operational amplifiers and provided with an integrating feedback loop. The output of the amplifier serves as the output of the source.

The comparator preferably includes an operational amplifier having two resistors placed in parallel with its inverting input. The resistors serve as the input resistors of the comparator. The output of the operational amplifier is coupled to its inverting input via a capacitor.

The integrating circuit and the integrating feedback loop are preferably built around operational amplifiers.

According to the invention, the reference voltage source includes a circuit with a time-varying transfer voltage ratio. The input of the circuit with a time-varying transfer voltage ratio is alternately connected to the outputs of the operational amplifiers of the bridge circuit, whereas the output of this circuit serves as the output of the source.

The circuit with a time-varying transfer voltage ratio is preferably built around a summing operational amplifier with a resistor and at least two switching circuits having in parallel with its inverting input, each of the switching circuits having a controlled switch and a resistor connected in series.

The point of connection between the controlled switch and resistor of each of the aforedescribed circuits may be connected via a respective switch to the non-inverting input of the summing operational amplifier.

A low pass filter is preferably connected to the output of the circuit with a time-varying transfer voltage ratio.

BRIEF DESCRIPTION OF THE ACCOMPANYING DRAWINGS

Other objects and advantages of the present invention will become more apparent from the following detailed description of preferred embodiments thereof to be read in conjunction with the accompanying drawings, wherein.

DETAILED DESCRIPTION OF THE INVENTION

Figure 1:
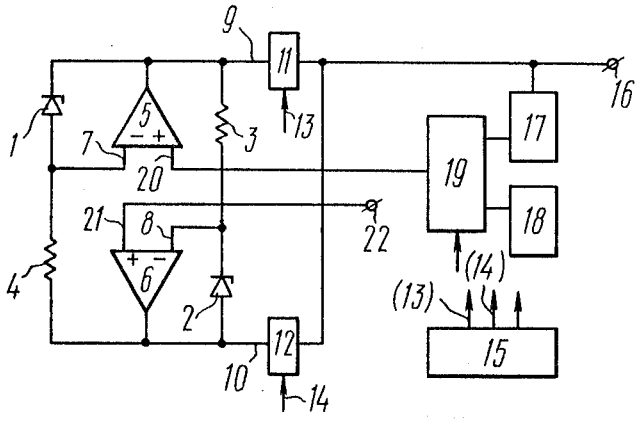
FIG. 1 is a block diagram of an embodiment of the reference voltage source of the invention.

The reference voltage source of the invention is based on a bridge circuit having avalanche diodes 1 and 2 (FIG. 1) in a first pair of opposite arms and resistors 3 and 4 in a second pair of opposite arms. The source includes two operational amplifiers 5 and 6. The output of the first operational amplifier 5 is connected to the cathode of the avalanche diode 1 and the output of the second operational amplifier 6 is connected to the anode of the avalanche diode 2. The inverting input 7 of the amplifier 5 is connected to the anode of the avalanche diode 1. The inverting input 8 of the amplifier 6 is connected to the cathode of the avalanche diode 2. The outputs of the amplifiers 5 and 6 are connected to inputs 9 and 10 of first and second switches 11 and 12, respectively. Control inputs 13 and 14 of the switches 11 and 12, respectively, are connected to outputs of a clock pulse generator 15. The outputs of the switches 11 and 12 are combined and connected to an output terminal 16 of the source.

According to the invention, the reference voltage source further includes an AC-DC voltage converter or full-wave rectifier 17 having an input connected to the output terminal 16, and a DC voltage setting circuit 18. The outputs of the converter 17 and of the circuit 18 are connected to the inputs of a voltage comparator 19, whose output is connected to a non-inverting input 20 of the amplifier 5. A non-inverting input 21 of the operational amplifier 6 is connected to an input terminal 22, whereto control voltage is applied.

Figure 2:
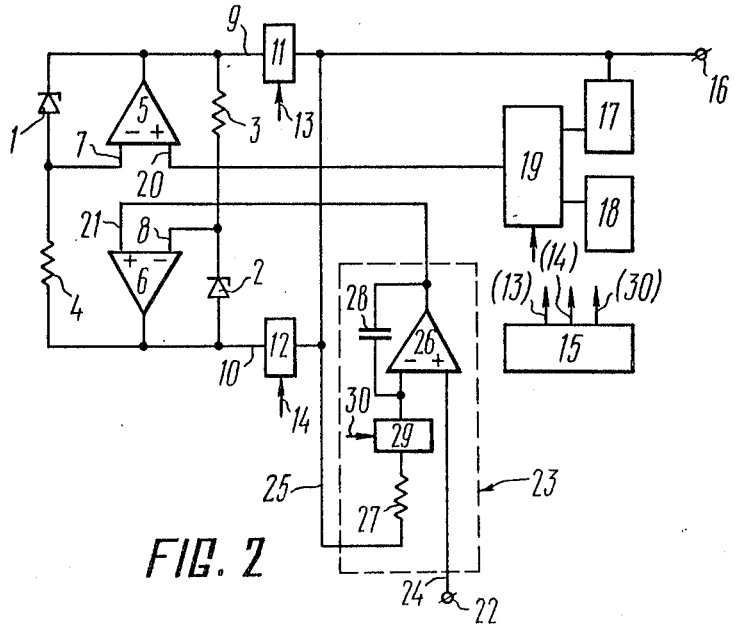
FIG. 2 is a block diagram of another embodiment of the reference voltage source of the invention, including an integrating circuit.

In order to provide for a specific bias of the output voltage with respect to the DC voltage, the source of the invention includes an integrating circuit 23 (FIG. 2) having an input 24 combined with the input terminal 22 of the source. An input 25 of the integrating circuit 23 is connected to the combined outputs of the switches 11 and 12. The output of the integrating circuit 23 is connected to the non-inverting input 21 of the amplifier 6.

The integrating circuit 23 is preferably built around an operational amplifier 26 with an input resistor 27 and a capacitor 28 connected in its feedback loop. The non-inverting input of this amplifier is the input 24 of the circuit 23. A switch 29 is connected to the non-inverting input of the amplifier 26. The control input 30 of the switch 29 is connected to the generator 15.

Figure 3:
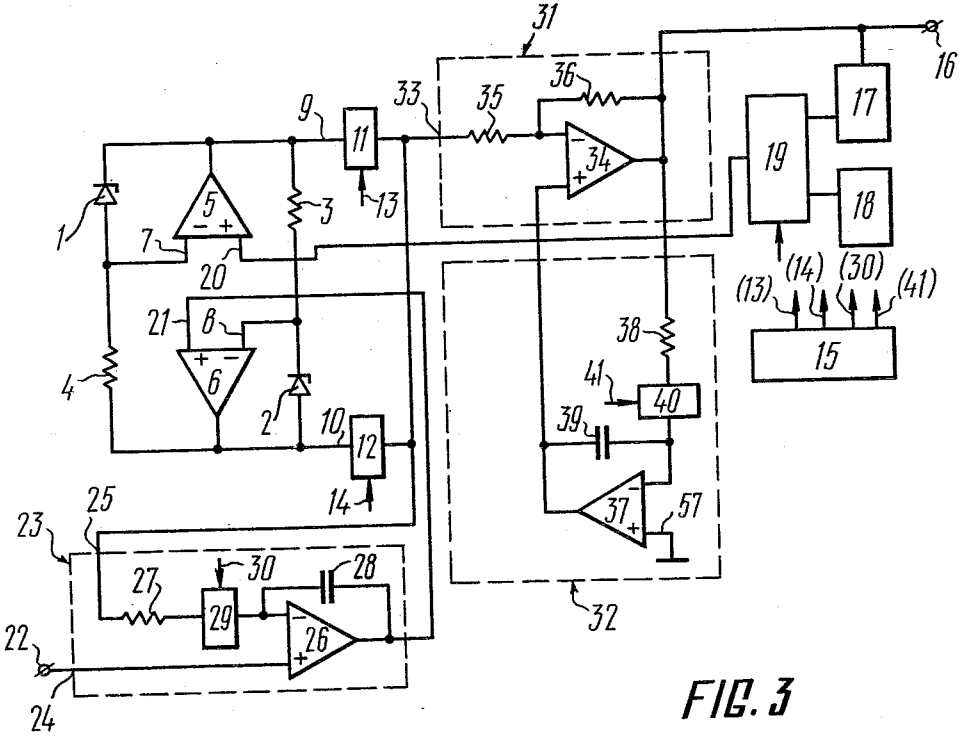
FIG. 3 is a block diagram of a still another embodiment of the reference voltage source of the invention including an integrating circuit and an amplifier.

In order to provide for high voltages with a low-resistance output, it is necessary that an amplifier 31 (FIG. 3) be connected at the output of the source and provided with an integrating feedback loop 32. An input 33 of the amplifier 31 is connected to the combined outputs of the switches 11 and 12. The amplifier 31 is built around an operational amplifier 34 with resistors 35 and 36 connected to its input and in the feedback loop, respectively.

Also connected in the integrating feedback loop 32 is an integrating operational amplifier 37 with a resistor 38 connected to its inverting input and a capacitor 39 connected in the feedback loop. A switch 40 is connected to the inverting input and has a control input 41 connected to the output of the clock pulse generator 15.

Figure 4:
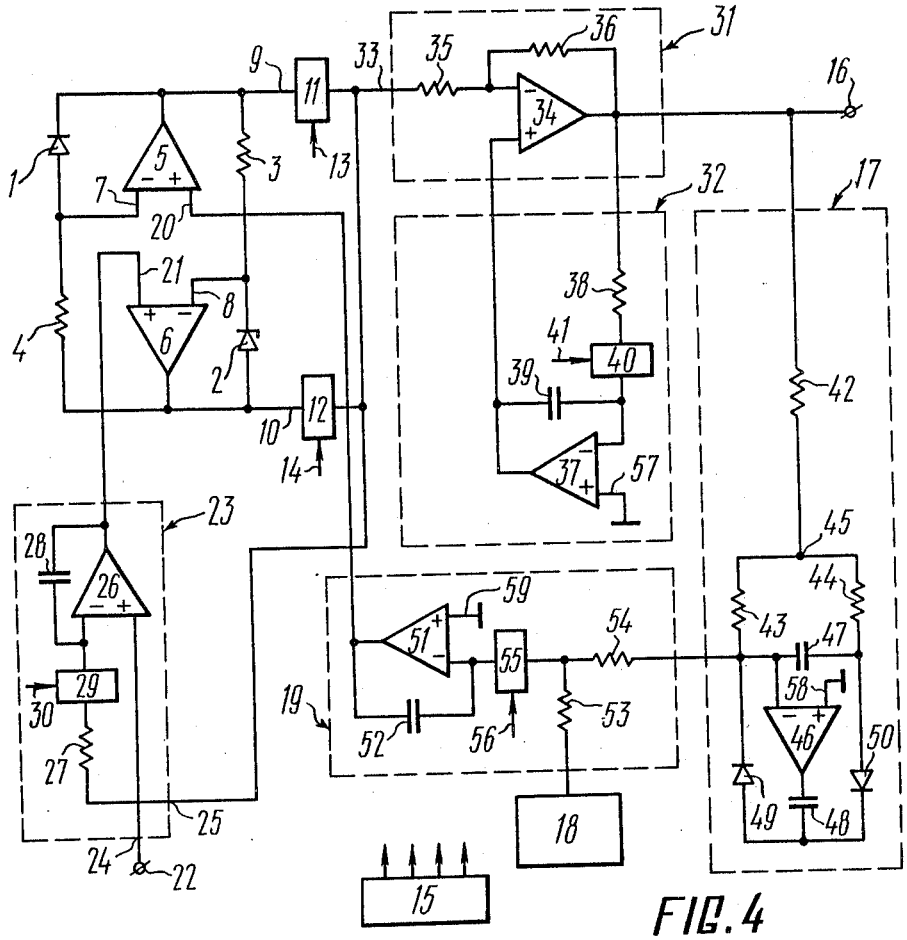
FIG. 4 is a key diagram of yet another embodiment of the reference voltage source of the invention.

FIG. 4 presents an alternative embodiment of the converter 17 and the comparator 19. The AC-DC voltage converter 17 includes, as shown in FIG. 4, a high-voltage resistor 42 and two resistors 43 and 44. The resistor 42 is connected to a common point 45 of connection of the resistors 43 and 44. An operational amplifier 46 is connected to a common point in the connection between the resistor 43 and a capacitor 47.

The capacitor 47 is connected to the input of the amplifier 46. A capacitor 48 is connected to the output of the amplifier 46. Diodes 49 and 50 are connected in the feedback loop and are also connected to the resistors 43 and 44.

The comparator 19 is built around an integrating operational amplifier 51 with a capacitor 52 connected in its feedback loop and with input resistors 53 and 54. A switch 55 is connected to the input of the amplifier 51. The control input 56 of the switch 55 is connected to the output of the clock pulse generator 15. The resistor 53 is coupled directly to the inverting input of the integrating operational amplifier 51 via the switch 55. The resistor 54 and the capacitor 47 are coupled to the inverting input of the integrating operational amplifier 51 via the switch 55.

Non-inverting inputs 57, 58 and 59 of the amplifiers 37, 46 and 51, respectively, are grounded.

Figure 5:
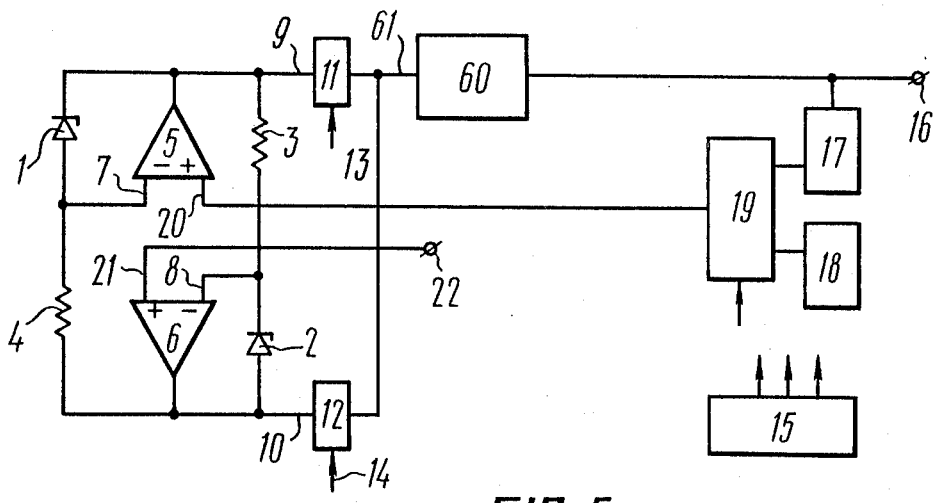
FIG. 5 is a key diagram of another embodiment of the reference voltage source of FIG. 4, provided with a circuit with a time-varying transfer voltage ratio.

In the alternative embodiment of FIG. 5, the reference voltage source of the invention includes a circuit 60 with a time-varying transfer voltage ratio. The input 61 of the circuit 60 is connected to the combined outputs of the switches 11 and 12 an its output serves as the output of the source.

Figure 6:
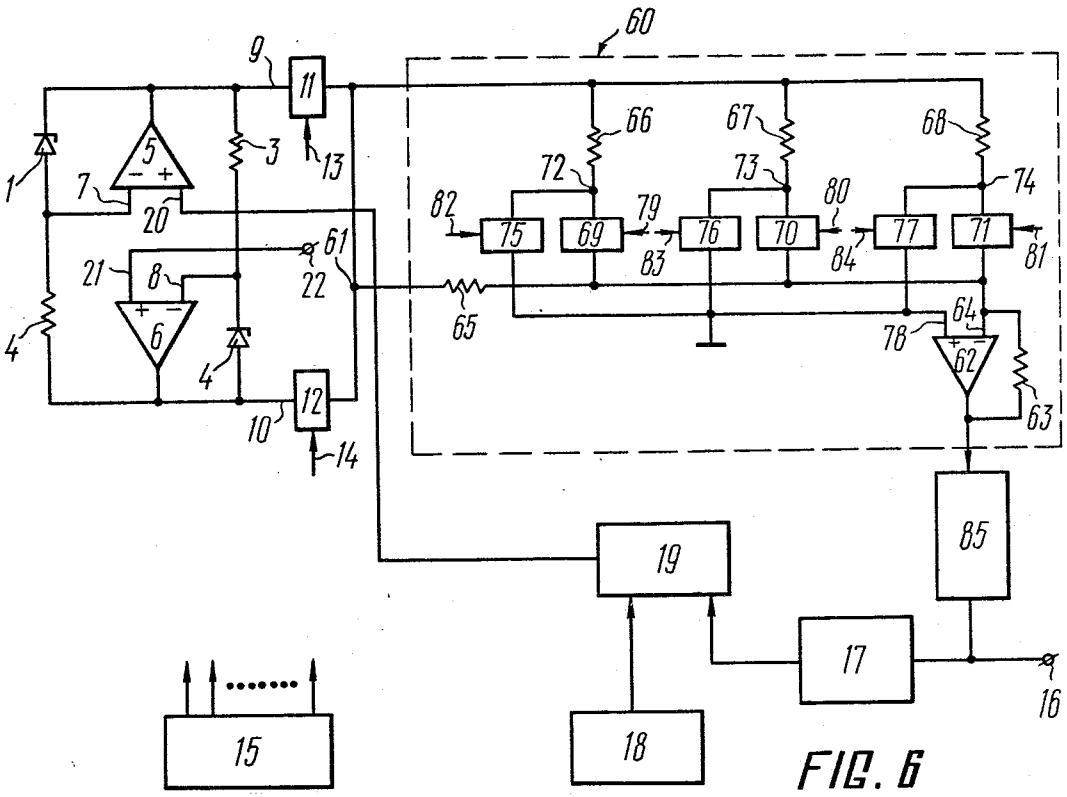
FIG. 6 is a block diagram of still another embodiment of the invention including the circuit with a time-varying transfer voltage ratio; and FIGS. *7a, 7b, 7c, 7d,* and *7e* are time plots illustrating the operation of the circuit of the invention with a time-varying transfer voltage ratio.
Figures 7A, 7B, 7C, 7D, 7E:
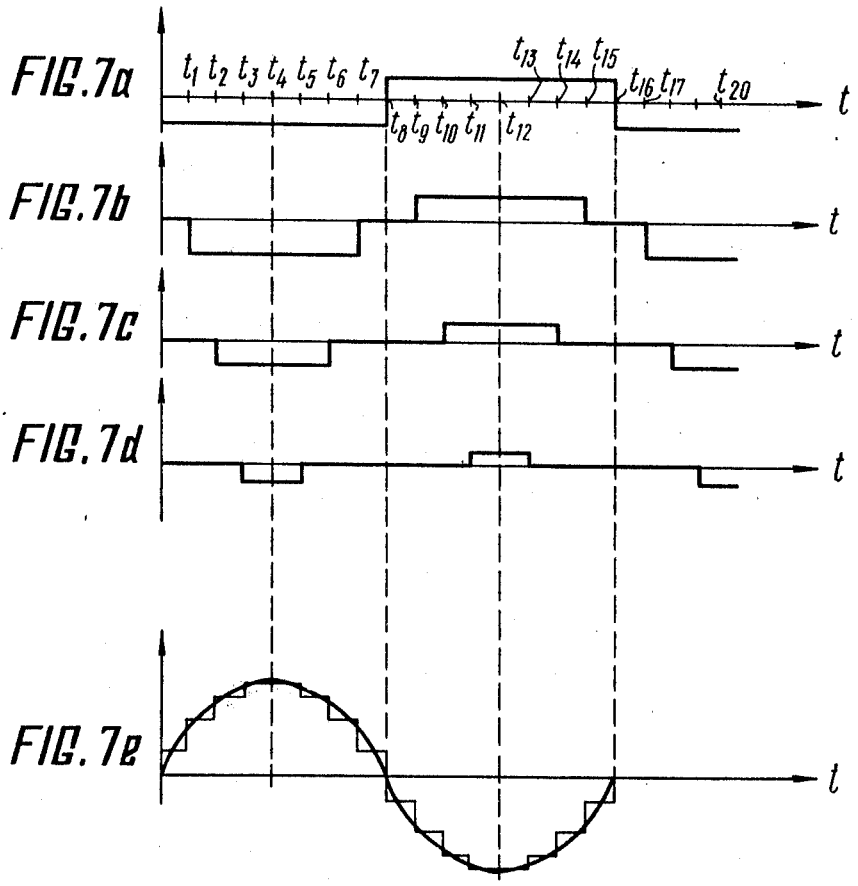

The circuit 60 is built around a summing operational amplifier 62 (FIG. 6) with a resistor 63 connected in its feedback loop. An inverting input 64 of the amplifier 62 is connected to a resistor 65 and "n" parallel switching circuits, each comprising a resistor and a switch. FIG. 6 is a simplified circuit comprising three circuits containing resistors 66, 67 and 68 and switches 69, 70 and 71, respectively. Respective switches 75, 76 and 77 are connected to points 72, 73 and 74 of connection of the resistors 66, 67 and 68 and switches 69, 70 and 71, respectively. The switches 75, 76 and 77 are all connected to a non-inverting input 78 of the amplifier 62.

Control inputs 79, 80 and 81 of the switches 69, 70 and 71, respectively, are connected to the outputs of the clock pulse generator 15.

A low pass filter 85 is connected to the output of the circuit 60.

The reference voltage source of the invention (FIGS. 1 to 4) operates as follows.

The operational amplifiers 5 and 6 are provided with a bipolar supply so that their output voltages are variable within broad limits.

When operating under steady-state conditions, the voltage produced at the output of the operational amplifier 5 is positively biased with respect to the voltage across its non-inverting input 20 by a value corresponding to the voltage drop across the avalanche diode. The voltage produced at the output of the operational amplifier 6 is negatively biased with respect to the voltage at its non-inverting input 21 by a value corresponding to the voltage drop across the avalanche diode 2. The output voltages of the amplifiers 5 and 6 are applied by the switches 11 and 12 to the output terminal 16, either directly or via the amplifier 31. As a result, a square-wave AC output voltage is produced at the output of the source.

The AC to DC voltage converter 17 smoothes the output voltage of the source and converts it to a DC voltage by full-wave rectification. The voltage comparator 19 then compares the rectified voltage with the preset DC voltage, whereupon the rectified voltage is applied to the non-inverting input 20 of the amplifier 5. The phase is selected so that if the output voltage is in excess of the set voltage, a negative signal is produced at the output of the comparator 19, whereby the output voltage of the amplifier 5 is reduced until the signals at the inputs of the comparator 19 are equalized.

The comparator 19 operates as follows. A positive full-wave detected voltage is applied to its input, that is, to the inverting input of the amplifier 51, from the converter 17 via the resistor 54. A negative DC voltage is applied to its input from the voltage setting circuit 18 via the resistor 53. The difference between the currents flowing through the resistors 53 and 54 is integrated by the operational amplifier 51 and applied to the input 20 of the amplifier 5. If the output voltage of the source is in excess of the preset voltage across the circuit 18, the current flowing through the resistor 54 is in excess of the compensation current flowing through the resistor 53, which accounts for a negative change in the voltage across the output of the amplifier 51. As a result, the output voltage of the amplifier 5 and the voltage across the input and output of the amplifier 31 are reduced until the voltages at the inputs of the comparator 19 are equalized. This means that the currents flowing through the resistors 53 and 54 are of equal magnitudes, but opposite polarities.

Apart from rough stabilization of the output voltages of the amplifiers 5 and 6 due to the use of the bridge circuit, the reference voltage source circuitry of the invention provides for a finer stabilization of these voltages by eliminating minor deviations of the output voltage from preset values. The reference voltage source of the invention also features a high noise immunity and good time stability.

The integrating circuit 23 serves to adjust the voltage at the non-inverting input 21 of the amplifier 6 so that the constant component of the signal at the output of the switches 11 and 12 is equal to the control voltage across the input terminal 22.

If the constant component of the signal at the output of the switches 11 and 12, this is at the input 25 of the integrating circuit 23, differs from the control voltage at the input terminal 22, current is passed through the resistor 27 to charge the capacitor 28 until the output voltage of the integrating circuit 23 and voltages at the non-inverting input 21 of the amplifier 6, the output of the amplifier 6 and the input 25 are changed to equalize the constant component of the signal at the input 25 and the control voltage at the input terminal 22.

The source of FIGS. 5 and 6 operates as follows. The output voltages of the amplifiers 5 and 6 are alternately applied via the switches 11 and 12 to the input of the circuit 60 with a time-varying transfer voltage ratio, and then, via the low pass filter 85, to the output of the source. The sinusoidal output voltage thus produced is converted to a smoothed DC voltage by the converter 17, whereupon the comparator 19 compares it with the DC voltage. The difference of these voltages is applied to the non-inverting input 20 of the amplifier 5, and the phase is selected so that if the output voltage is in excess of a desired value, the output signal of the comparator 19 is negative, whereby the output voltage of the amplifier 5 is reduced. According to the preferred embodiment of FIG. 6, the circuit 60 with a time-varying transfer voltage ratio comprises the summing operational amplifier 62, whose inverting input 64 is connected to the outputs of the switches 11 and 12.

As shown in FIG. *7a*, voltage is continuously applied to the input 64 of the amplifier 62 via the resistor 65, whereas voltage is applied via the resistor 66 and the switch 69 to the input 64 only during periods from $t_1$ to $t_7$ and from $t_9$ to $1_{15}$ (FIG. *7b*). Accordingly, voltage is applied via the resistor 67 and the switch 70 during periods from $t_2$ to $t_6$ and from $t_{10}$ to $t_{14}$ (FIG. *7c*). Voltage is applied via the resistor 68 and the switch 71 during periods from $t_3$ to $t_5$ and from $t_{11}$ to $t_{13}$ (FIG. *7d*).

Current pulses passing through the resistors 65, 66, 67 and 68, and represented in FIGS. *7a*, *7b*, *7c* and *7d*, respectively, are added together so that a voltage is produced at the output of the operational amplifier which approximates a sinusoid (FIG. *7e*).

The approximation can be made highly accurate by appropriately selecting the resistances of the resistors 65, 66, 67 and 68 and the switches 69, 70 and 71, as well as the number of parallel circuits.

The signal thus produced is applied to the low pass filter 85 which suppresses the higher harmonic components. For example, the filter 85 may be a three-pole filter, in which case the overall distortion of the sinusoidal signal at its output is less than 0.005 percent.

When the switches 69, 70 and 71 are in the off position, the switches 75, 76 and 77 serve to direct the current flowing through the resistors 66, 67 and 68, respectively, to a common bus. As a result, there are no voltage surges at the output of the switches 11 and 12, and the output signal of the operational amplifier is free from voltage peaks at the times that the switches 69, 70 and 71 are switched. The remainder of the source of FIGS. 5 and 6 operates as hereinbefore described.

The comparator 19, the integrating circuit 23 and the integrating feedback loop 32 are provided with the switches 55, 29 and 40 in order to maintain the original DC voltage across the non-inverting inputs of the operational amplifiers 5, 6 and 34 when DC voltage is applied to the output terminal 16. The switches 55, 29 and 40 are brought to the "on" position, and the DC voltages at the outputs of the amplifiers 51, 26 and 37 remain unchanged due to the absence of current in the capacitors 52, 28 and 39, respectively. This makes it convenient to check the circuits and units of the reference voltage source, since a precision digital voltmeter may be used to determine the values of output voltages of different polarities with specific resistance ratios of the resistors 42, 43, 44, 53 and 54. If necessary, the resistance ratios of these resistors may be adjusted while the output voltages are within prescribed limits.

The accuracy of the reference voltage source according to the invention is never below 0.01 percent and is only dependent upon the accuracy with which the resistance ratios of the resistors 53, 54 and 42, 43 and 44 are selected.

The source of FIGS. 5 and 6 has the following advantages.

The circuit 60 with a time-varying transfer voltage ratio transforms a square signal into a step signal which approximates a sinusoid. The low pass filter 85 suppresses the higher harmonic components, so that a sinusoidal signal is produced at the output of the source. The step signal approximates a sinusoid in such a way that changes occur at equal intervals 4 m times during a period, so that the step signal is symmetrical with respect to the centers of half periods and crosses zero at the same points as the sinusoid being approximated. As a result, the output signal is free from even higher harmonic components. By selecting a specific ratio between additional step-like voltage variations, the signal is rid of "m" first odd harmonic components, as well as of odd higher harmonic components whose series number is "4mk" more than the series number of the first harmonic components (k=1, 2, 3 . . . ). For example, with three additional switches, the first higher harmonic component of the signal is the fifteenth, and its amplitude is 1/15 of the fumdamental harmonic. With the use of a low pass filter of the third order, the total distortion at the output is less than 0.005 percent. Thus the reference voltage source of the invention permits the provision of an essentially sinusoidal signal at its output.

What is claimed is:

1. A reference voltage source, comprising an input terminal and an output terminal;

means for applying a control voltage to said input terminal;

a bridge circuit having a first pair of opposite arms, a second pair of opposite arms, two avalanche diodes connected in the first pair of opposite arms and two resistors connected in the second pair of opposite arms;

a first operational amplifier having an inverting input, a non-inverting input and an output, the inverting input of said first operational amplifier being connected to the anode of said first avalanche diode and the output of said first operational amplifier being connected to the cathode of said first avalanche diode;

a second operational amplifier having an inverting input, a non-inverting input and an output, the inverting input of said second operational amplifier being connected to the cathode of said second avalanche diode, the non-inverting input of said second operational amplifier being connected to said input terminal of said source, and the output of said second operational amplifier being connected to the anode of said second avalanche diode, the outputs of said first and second operational amplifiers being alternately connected to said output terminal of said source;

an AC-DC voltage converter having an input connected to said output terminal and an output;

a DC voltage setting circuit having an output;

a comparator having a first input connected to the output of said converter and a second input connected to the output of said DC voltage setting circuit and an output connected to the non-inverting input of said first operational amplifier.

2. A reference voltage source as claimed in claim 1, further comprising an integrating circuit having a first input connected to said input terminal of said source, a second input connected to the outputs of said first and second operational amplifiers and an output connected to the non-inverting input of said second operational amplifier.

3. A reference voltage source as claimed in claim 1, further comprising an amplifier having an input alternately connected to the outputs of said first and second operational amplifiers and an output serving as said output of said source, said amplifier having an integrating feedback loop.

4. A reference voltage source as claimed in claim 1, further comprising a circuit with a time-varying transfer voltage ratio, said circuit having an input alternately connected to the outputs of said first and second operational amplifiers and an output functioning as said output of said source.

5. A reference voltage source as claimed in claim 1, wherein said comparator includes an integrating operational amplifier having an inverting input and an output, a first resistor coupled directly to the inverting input of said operational amplifier, a capacitor, a second resistor and said capacitor coupled to the inverting input of said operational amplifier, and another capacitor connected between the output and the inverting input of said integrating operational amplifier.

6. A reference voltage source as claimed in claim 2, wherein said integrating circuit is built around an operational amplifier.

7. A reference voltage source as claimed in claim 3, wherein said integrating feedback loop is built around an integrating operational amplifier.

8. A reference voltage source as claimed in claim 4, wherein said circuit with a time-varying transfer voltage ratio comprises a summing operational amplifier having an inverting input, a non-inverting input and an output, a resistor connected to the inverting input of said summing operational amplifier, at least two switching circuits connected in parallel with said resistor and connected to the inverting input of said summing operational amplifier, each of said circuits having a resistor and a first switch connected in series.

9. A reference voltage source as claimed in claim 4, further comprising an integrating circuit having a first input connected to said input terminal of said source, a second input alternately connected to the outputs of said first and second operational amplifiers, and an output connected to the non-inverting input of said second operational amplifier.

10. A reference voltage source as claimed in claim 4, further comprising an amplifier having an input alternately connected to the outputs of said first and second operational amplifiers and an output functioning as said output of said source, said amplifier having an integrating feedback loop.

11. A reference voltage source as claimed in claim 4, further comprising a low pass filter connected to the output of said circuit with a time-varying transfer voltage ratio.

12. A reference voltage source as claimed in claim 8, further comprising an integrating circuit having a first input connected to said input terminal of said source, a second input alternately connected to the outputs of said first and second operational amplifiers and an output connected to the non-inverting input of said second operational amplifier.

13. A reference voltage source as claimed in claim 8, further comprising an amplifier having an input alternately connected to the outputs of said first and second operational amplifiers and an output functioning as said output of said source, said amplifier having an integrating feedback loop.

14. A reference voltage source as claimed in claim 8, wherein said circuit with a time-varying transfer voltage ratio further comprises a second group of switches, each of the switches of said second group being connected between the point of connection of a corresponding one of the resistors and a corresponding one of the switches of said switching circuits and the non-inverting input of said summing operational amplifier.

15. A reference voltage source as claimed in claim 12, further comprising an amplifier having an input alternately connected to the outputs of said first and second operational amplifiers and an output functioning as said output of said source, said amplifier having an integrating feedback loop.

16. A reference voltage source as claimed in claim 15, further comprising a low pass filter connected to the output of said circuit with a time-varying transfer voltage ratio.

* * * * *